US006399910B1

(12) United States Patent
Crawford et al.

(10) Patent No.: US 6,399,910 B1
(45) Date of Patent: Jun. 4, 2002

(54) SWITCH ASSEMBLY INCORPORATING DEFLECTABLE SPRING CONTACT

(75) Inventors: James F. Crawford, Newton; Jeffrey L. Sears, Grinnell; Harold T. Wilson, Colfax, all of IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/783,005

(22) Filed: Feb. 15, 2001

(51) Int. Cl.[7] ..... H01H 5/00
(52) U.S. Cl. ..... 200/405; 200/276; 200/520
(58) Field of Search ..... 200/276, 276.1, 200/277, 277.1, 520, 562, 405

(56) References Cited

U.S. PATENT DOCUMENTS 4,052,580 A * 10/1977 Stanish ..... 200/159 R
4,694,130 A * 9/1987 Kitzmann et al. ..... 200/314
4,976,628 A * 12/1990 Fedder ..... 439/101
5,055,642 A * 10/1991 Miyate ..... 200/293
6,222,144 B1 * 4/2001 Nishikawa ..... 200/537

* cited by examiner

*Primary Examiner*—Elvin Enad
*Assistant Examiner*—Kyung S. Lee
(74) *Attorney, Agent, or Firm*—Diederiks & Whitelaw, PLC

(57) ABSTRACT

A switch assembly includes a housing within which is arranged a convex, over-center spring which deforms when pressure is applied to a push button. In a default position, the push button sits atop an apex of the spring, with the spring being spaced from a contact associated with a first electrical lead. One end of the spring projects from the housing and defines a second electrical lead. When pressure is applied to the push button, the spring is pushed into electrical communication with the contact, thus completing a circuit between the electrical leads. In a first embodiment, a base housing member and a separate snap-on cover is provided. In a second embodiment, the cover is attached to the base housing via a living hinge. In both the first and second embodiments, the cover assists in holding the spring in the default position.

20 Claims, 11 Drawing Sheets

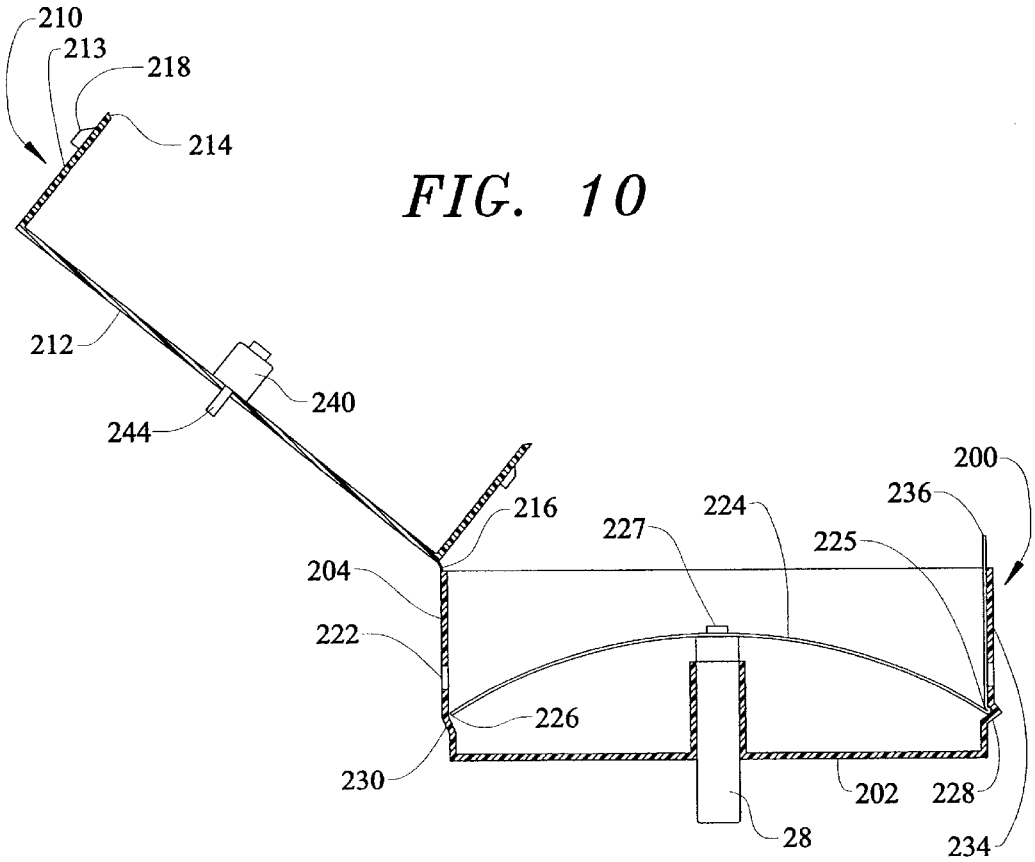
FIG. 10
FIG. 11
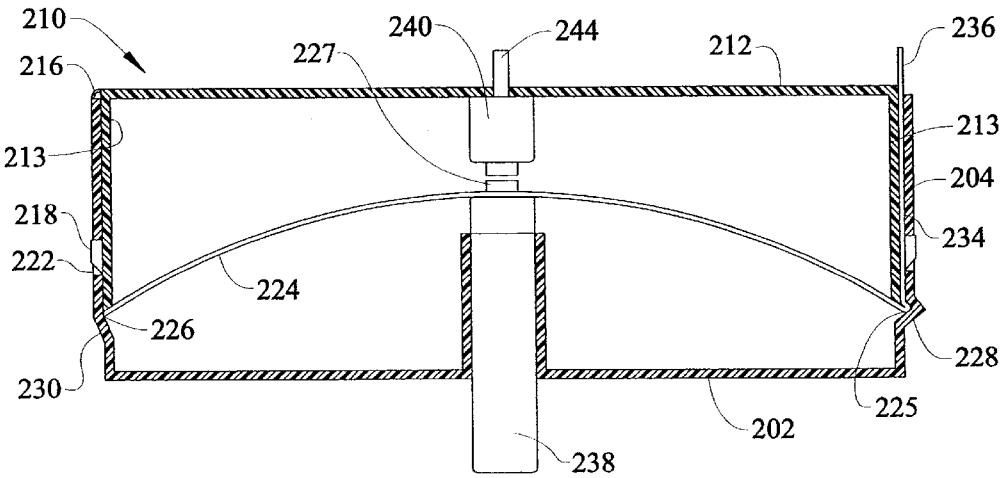

SWITCH ASSEMBLY INCORPORATING DEFLECTABLE SPRING CONTACT

BACKGROUND OF THE INVENTION

1. Field of the Invention

The present invention pertains to the art of electrical switches and, more particularly, to a switch assembly which utilizes a push button to deflect a spring to unite a mobile contact with a stationary contact.

2. Discussion of the Prior Art

It is well known in the art to provide a push button actuator for an electric or electronic switch. More specifically, it is known to utilize a plunger or push button within a housing to bias a spring member which, when pressure is applied to the push button, brings various contacts into electrical communication. Many of the recent designs represent attempts to eliminate either the number of moving parts, the number of total parts, the assembly time or assembly costs.

In a common design, a push button, which extends outside of a housing, is located over a curved spring. Two contacts are located beneath the spring, and when the spring is depressed via the push button, the two contacts are brought into electrical communication. For example, U.S. Pat. No. 5,055,642, issued to Miyata, describes a push button switch in which two electrical contacts are fixed in a location beneath a concave spring or diaphragm. Three contacts are disposed on a base inside the housing, below the diaphragm, with two laterally disposed and one at the center. With the push button in a default position, the diaphragm is maintained in a concave condition, with each of its two ends in contact with a respective, laterally disposed contact. When pressure is applied to the push button, the diaphragm is deformed, from its concave shape, so as to bring the centrally located contact into electrical communication, across the diaphragm itself, with the laterally spaced contacts. The result is a snap-action push button switch which operates via a deformable diaphragm. This design works well, but maintains a number of flaws. First, the movement of the diaphragm from the concave position to a position in which it may abut both the lateral and central contacts puts substantial strain on the diaphragm itself. In addition, in such a design, each contact represents a fixed piece in the housing and is not designed to be removed for repair or replacement.

U.S. Pat. No. 4,789,764, issued to Doros, describes an attempt to overcome these problems. In that design, a concave-convex spring element is disposed within a housing with a fixed contact disposed not on the base of the housing, but above the spring and laterally of a centralized push button. Because this spring element does not extend outside of the housing, a fixed end of the spring element functions as an electrical lead to which a wire may be connected. Due to the contorted shape of this spring element and the design of the housing, a non-fixed end of the spring is forced into electrical communication with the fixed electrical contact. As in U.S. Pat. No. 5,055,642, actuation of the push button causes extreme deformation of the spring element in order to bring the contacts into electrical communication. Although these two designs contain only a few moving parts, the parts that do move, i.e. the spring element, diaphragm, and push button, move a relatively great distance, as compared to the total structure. The existence and extent of these moving parts is considered to present a number of stress points making the overall design prone to failure.

Switch assemblies, generally constructed in the manner set forth above, can be used in various environments. One particular environment of concern is in appliances, particularly clothes washing and drying machines. In such appliances, it is common to provide a control panel having various buttons which are associated with switches for enabling a consumer to select various operating parameters of the machine for a particular cycle. For instance, in the case of washing machines, it is common to provide a row of buttons which enable the consumer to select a desired water temperature for both washing and rinsing cycles. It would not be uncommon to provide a bank of buttons in a single housing, with the buttons being associated with switches and further being interconnected such that the depression of one button would automatically cause the release of another button. For example, if the bank of buttons or switches control the selection between hot/hot, warm/warm, warm/cold and cold/cold wash/rinse temperatures respectively, the depression of the button associated with the warm/warm setting would automatically cause any other depressed button in the bank to be released. In general, cams and levers are utilized to interconnect the various push buttons to operate in this manner. In any event, since the useful life of such an appliance can be quite long, the switches must be extremely reliable. However, the overall construction of the switch assembly directly affects its associated cost reflected in both the components themselves and the time needed for assembly and installation. In general, it is considered that the installation of conventional multi-switch devices are often difficult or time consuming. Primarily, the time and expense comes from being forced to install individual wires to at least two different locations for each switch in a known multi-switch device. In any event, there exists a need in the art for a push button switch assembly which overcomes the drawbacks of the prior art and which represents an overall switch which is easy to assemble, is cost effective and requires a minimum number of components, while being extremely reliable over a prolonged period of time.

SUMMARY OF THE INVENTION

The present invention is directed to a switch assembly which utilizes a small number of parts, is easy to assemble and functions in a reliable manner. In general, a switch assembly constructed in accordance with the present invention includes a center spring which carries a first contact and which is adapted to shift upon depression of a push button in order to abut a second contact which is mounted in a stationary position relative to an overall housing. In the most preferred embodiment, the second contact is placed in proximity to an apex of the spring, opposite the push button. When the push button is depressed, the spring shifts from a convex condition to a concave condition wherein the first and second contacts are engaged to complete an electrical circuit. Therefore, one embodiment utilizes an overcenter spring that can be selectively maintained in either an activating or a deactivating position.

In the most preferred form of the invention, the spring is held in place by the interaction of ends of the spring with portions of the housing. That is, the housing is specifically designed with a notch or groove therein into which at least one end of the spring is seated, while the other end of the spring is adapted to abut an opposing side of the housing. When pressure is applied to the center of the spring through the push button, the spring is caused to bend due to the engagement between the housing and each end portion of the spring. When the push button is completely depressed, the spring reaches its maximum deflection wherein the contacts are engaged. One end of the spring projects from the housing to readily enable a first wire to be attached to the switch assembly, and the housing is formed with an opening which enables another wire to be directly connected to the stationary contact. Therefore, in accordance with this embodiment, the switch assembly generally includes a housing, defined by a lower body portion and a cover, at least one stationary contact, the spring and the push button. The stationary contact, spring and push button are adapted to be pre-assembled within the lower housing portion and the cover is preferably snap-fittingly mounted thereon. In a second embodiment of the invention, the housing is formed of a one-piece unit with a living hinge interconnecting the body portion and the cover. In accordance with this embodiment, the second contact is preferably mounted to the cover in a position which aligns with the first contact carried by the spring when the cover is closed. Most preferably, the cover includes side leg portions which extend into the body portion of the housing and abut sections of the spring to retain the spring sections in desired grooves or detent portions of the housing body.

In accordance with the invention, multiple switches can be maintained in a single housing or a dedicated housing can be utilized for each switch. In addition, the switch assembly of the present invention can be readily designed to be an ON/OFF type switch as set forth in accordance with the first embodiment of the invention or as a momentary contact switch wherein only a relatively slight deflection of the spring is required to engage the first and second contacts. In any event, the switch assembly of the present invention requires only a minimum number of parts that can be easily assembled to establish an effective and reliable electrical switching system. When multiple switches are utilized in connection with a single housing, it is desired in accordance with the present invention to bundle various wires of the switch assembly in a harness block. Although the switch assembly of the present invention can be employed in a variety of environments, the switch assembly is seen to have particular applicability for use in the field of appliances.

Additional objects, features and advantages of the invention will become more readily apparent from the following detailed description of preferred embodiments thereof, when taken in conjunction with the drawings wherein like reference numerals refer to corresponding parts in the several views.

BRIEF DESCRIPTION OF THE DRAWINGS

FIG. 10 is a cross-sectional side view of the switch assembly of FIG. 9;

FIG. 11 is a cross-sectional side view of the switch assembly of FIG. 9, similar to that of FIG. 10, but depicting the cover in a closed condition.

DETAILED DESCRIPTION OF THE PREFERRED EMBODIMENTS

Figure 1:
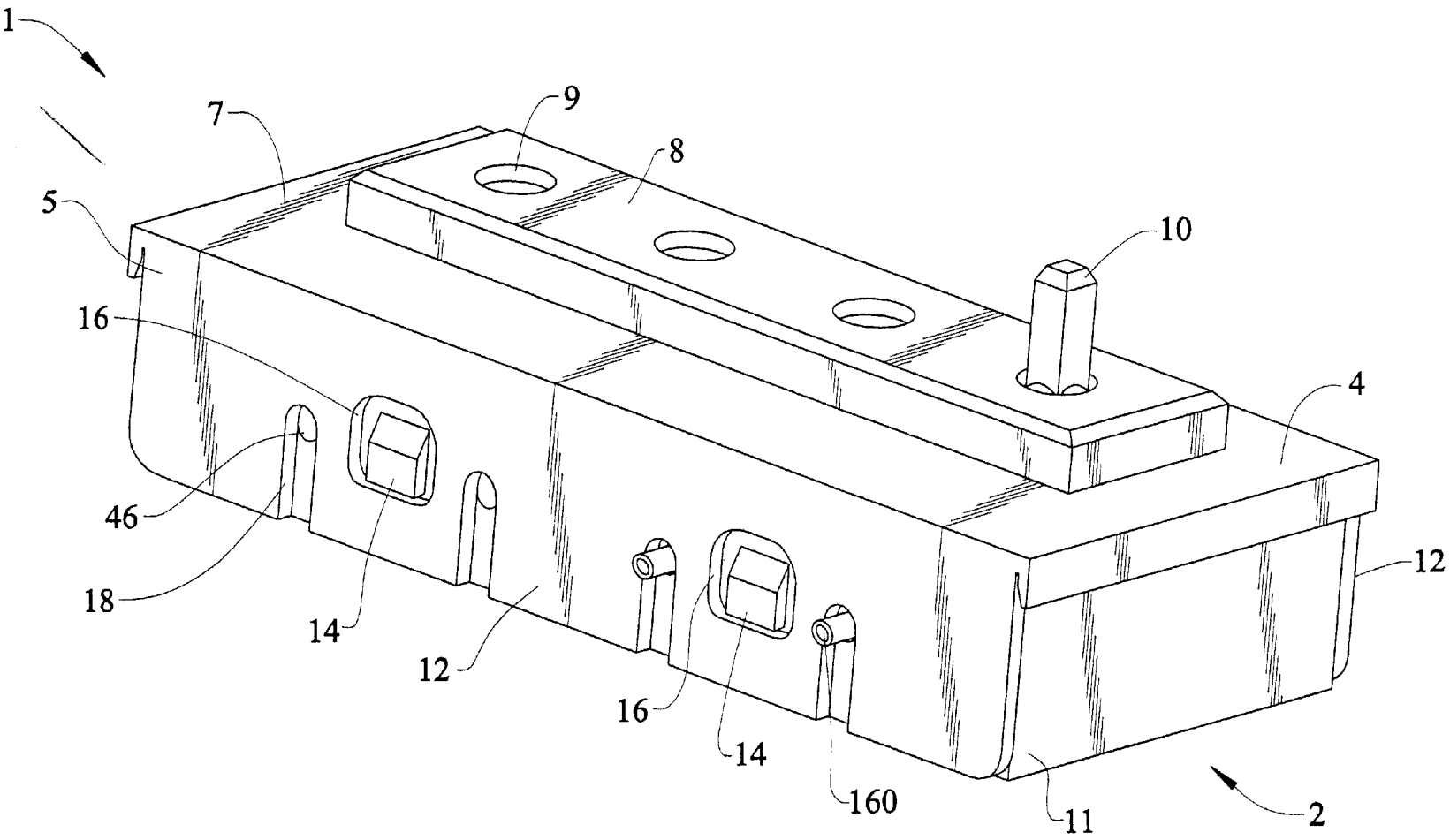
FIG. 1 is a perspective view of a switch assembly constructed in accordance with a first embodiment of the invention, with the switch assembly being shown in a partially assembled state.
Figure 2:
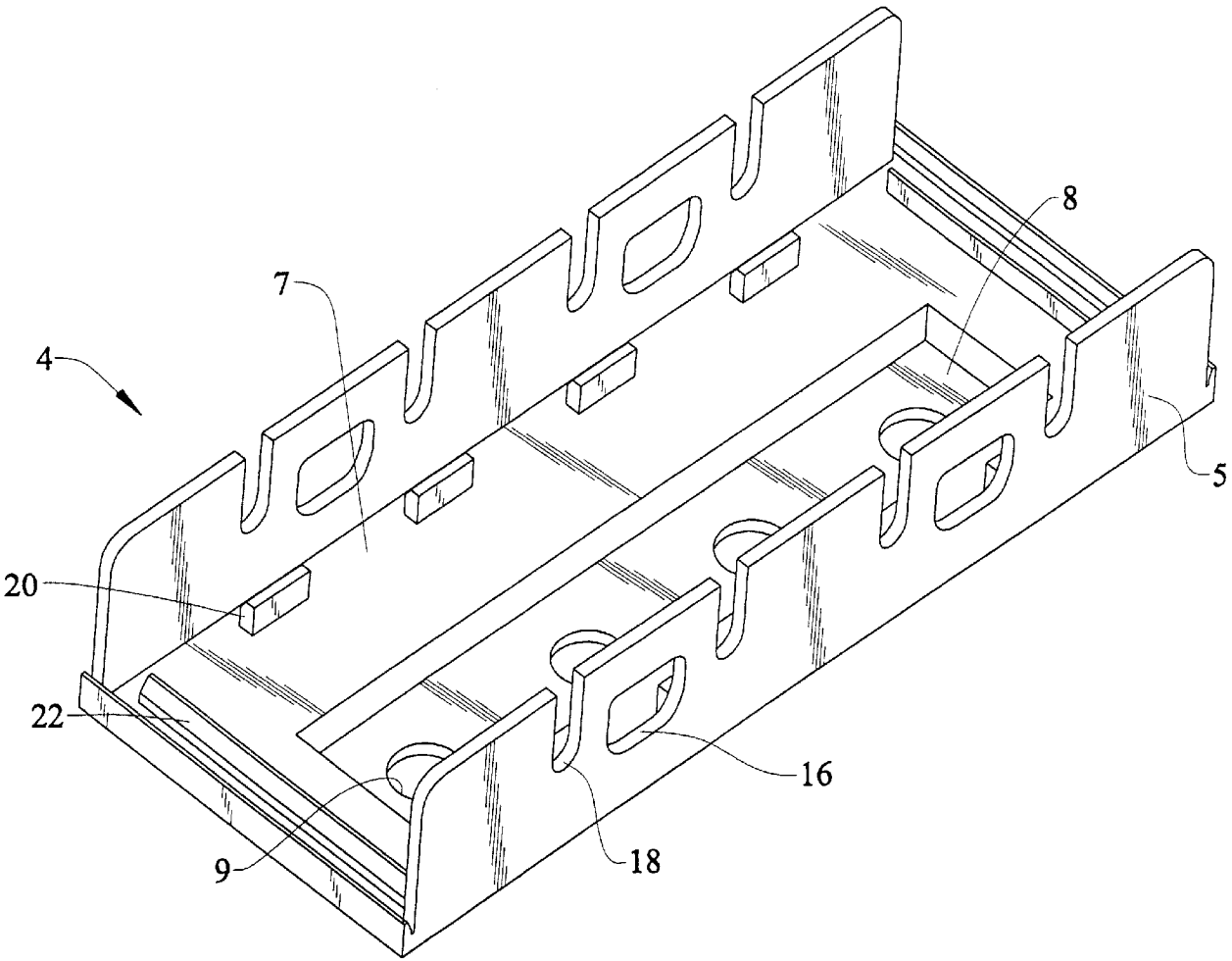
FIG. 2 is a perspective view of a cover incorporated in the switch assembly of FIG. 1.

A switch assembly 1 constructed in accordance with a first embodiment of the invention is depicted in FIG. 1 and generally includes a housing 2, with a cover 4. Cover 4, as also shown in FIG. 2, generally constitutes an open rectangular prism with two upstanding spaced apart elongated sides 5, with a top 7 therebetween. Top 7 includes a raised section 8 in the same general shape as the overall top 7 itself, but is smaller in both length and width. Raised section 8 includes four push button apertures 9, and is shown with one push button 10 protruding therethrough.

The shape of housing 2 corresponds to the general shape of cover 4. More specifically, housing 2 includes two upstanding, spaced apart short sides 11, two spaced apart long sides 12, and a bottom 13 (also see FIGS. 3 and 8). On each of the long sides 12, including the long side 12 which is obscured by the drawing, housing 2 includes a pair of cover mounting tabs 14. Mounting tabs 14 essentially constitute ramped protrusions which, when mated with corresponding cover mounting apertures 16, help to secure cover 4 onto housing 2. The ramped shape of the cover mounting tabs 14 enhances the ability of cover 4 to be slid down over housing 2 until tabs 14 project into cover mounting apertures 16. The cover mounting apertures 16 are generally the same shape as the cover mounting tabs 14, but are larger in each dimension to permit installation and removal of cover 4. In addition, cover mounting apertures 16, as well as cover mounting tabs 14, are situated on both long sides 5 of cover 4, as well as both long sides 12 of housing 2. This feature is more clearly shown in FIGS. 2, 3, and 8. Cover 4 is also provided with rounded, elongated slots 18 such that when a switch part extends through a respective long side 12, cover 4 can be installed without removing the switch parts as will be discussed more fully below.

The underside of cover 4, as best shown in FIG. 2, includes a plurality of short spacers 20 running along sides 5 and in line with slots 18. Apertures 16 can be seen on both sides of the cover 4, for mating with the cover mounting tabs 14 on the housing 2. Extending substantially across the length of top 7, on the inside of cover 4, are two spacers 22 located between and substantially perpendicular to sides 5. More specifically, spacers 22 run in parallel at either short end of cover 4 and on opposite sides of raised section 8. When cover 4 is installed on housing 2, spacers 20 and 22 ensure a proper fit between housing 2 and cover 4 of switch assembly 1.

Figure 3:
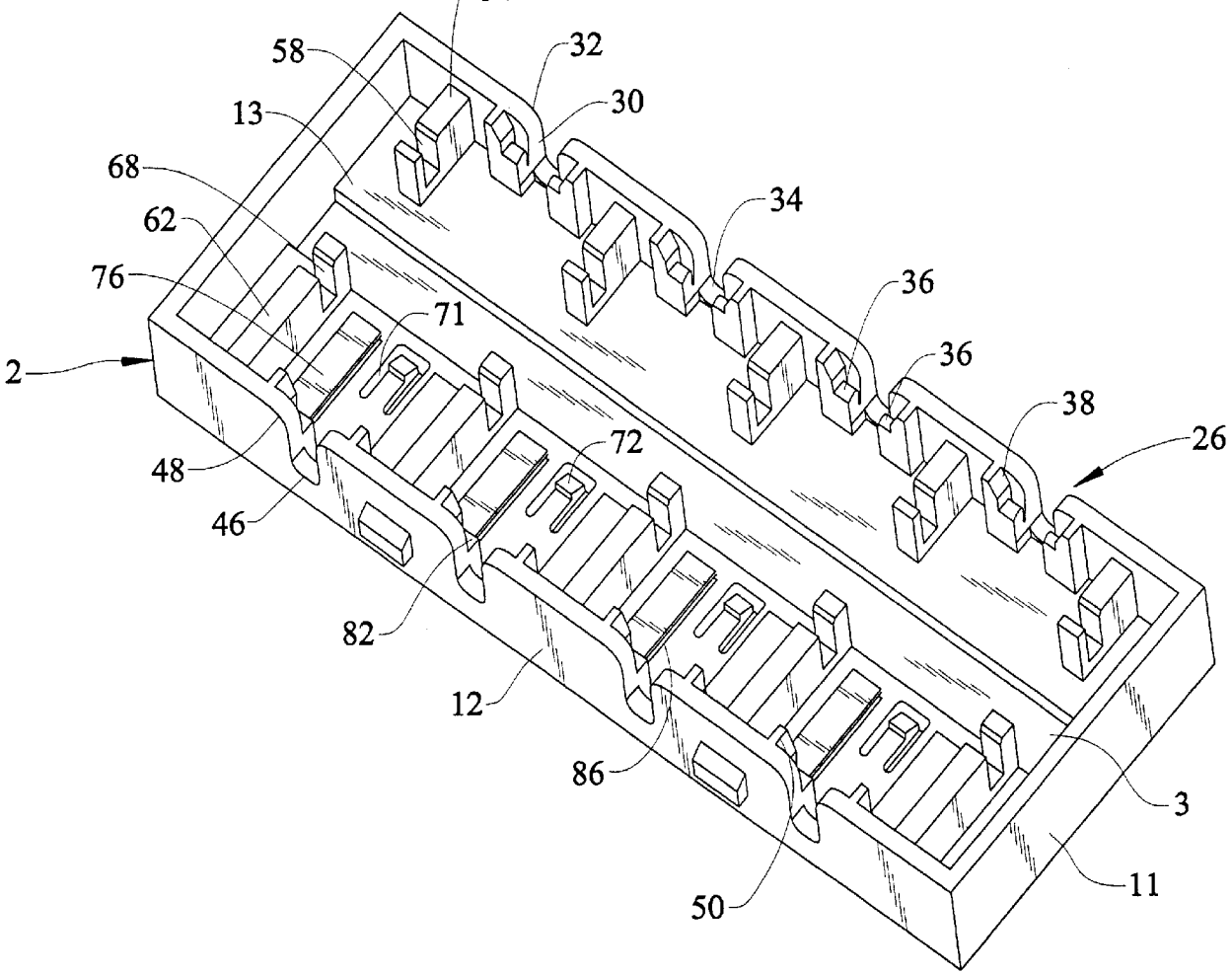
FIG. 3 is an upper perspective view of a lower housing portion of the switch assembly of FIG. 1.

FIG. 3 shows housing 2 with cover 4 and other parts of switch assembly 1 removed. Although housing 2 is shown with four identical switch bays 26, it should be realized that the invention requires only one switch bay 26 in housing 2, but preferably includes multiple switch bays 26 as shown. As each switch bay 26 is identical, the description of one switch bay 26 is sufficient to fully explain each of the included switch bays 26. In general, each switch bay 26 is designed to receive additional parts of switch assembly 1. On one of sides 12 of housing 2 is a squared slot 30 which extends substantially, but not completely down, the face of side 12 towards bottom 13, leaving a section of side 12, below squared slot 30 intact. On either side of squared slot 30, opposite the bottom thereof, are radiused surfaces 32. The bottom of squared slot 30 defines a lower plateau 34, while an upper plateau 36 is formed more towards the inside of housing 2. The upper plateau 36 is split into two because it straddles squared slot 30. Located laterally outwardly and above each plateau 36 is a respective ramped surface 38.

On the opposing long side 12, and directly opposite each slot 30, is a respective rounded slot 46. Similar to squared slot 30, rounded slot 46 has two radiused surfaces 48 at its top, as well as opposing ramped surfaces 50 disposed adjacent to the radiused surfaces 48, but closer to the inside of housing 2. Each rounded slot 46 also extends substantially, but not completely, down the face of its respective side 12 toward bottom 13, leaving part of side 12, below the rounded slot 46 intact. Rounded slot 46 is also depicted in FIG. 1, behind a respective, aligned slot 18.

Projecting inward from one side 12 toward an opposing side 12 is a short mounting projection 54 (see FIG. 3). Near the innermost portion of mounting projection 54 is a mounting projection slot 58 which begins atop projection 54 and proceeds almost completely down to bottom 13 of housing 2. Each mounting projection 54 is arranged generally parallel to side 11 of housing 2. Just as rounded slot 46 is opposite squared slot 30, a long mounting projection 62 is opposite each short mounting projection 54. Long mounting projection 62 extends inward from its respective side 12 and is provided with an elongated mounting projection slot 68 close to its innermost side. Projections 54 and 68 are each designed to receive specially designed portions of push button 10. As will be described later with particular reference to FIG. 7, push button 10 is mounted through two short mounting projections 54 and two long mounting projections 62, along with their respective slots 58, 68. Therefore, each switch bay 26 includes two short mounting projections 54 and two long mounting projections 62 disposed spaced apart with square slot 30 and rounded slot 46 located between projections 54 and 62. However, when a single housing 2 includes more than one switch bay 26, adjacent switch bays 26 may share a short mounting projection 54 and a long mounting projection 62 which are between the switch bays 26. Thus, the required number of short projections 54 and long projections 62 each is preferably equal to the number of switch bays 26 plus one.

Disposed in bottom 13 of housing 2, spaced apart and in line with the rounded slot 46, is an aperture 71 with a contact mounting tab 72 cantilevered therein. As shown, one end of tab 72 is tapered and an opposing end is preferably molded integral with bottom 13 of housing 2. Positioned between each aperture 71 and a respective mounting projection 62 is a raised contact mounting member 76. Contact mounting member 76 begins adjacent, but not preferably abutting, side 12 and extends toward a center of housing 2 along bottom 13. As shown in FIG. 3, each switch bay 26 includes two contact mounting members 76, one on either side of a respective aperture 71. Each mounting member 76 defines an elongated groove 86, with the grooves 86 of the two mounting members 76 in adjacent switch bays 26 facing each other. Essentially, the two contact mounting members 76 on either side of respective aperture 71 and tab 72 are mirror images of each other.

Figure 4:
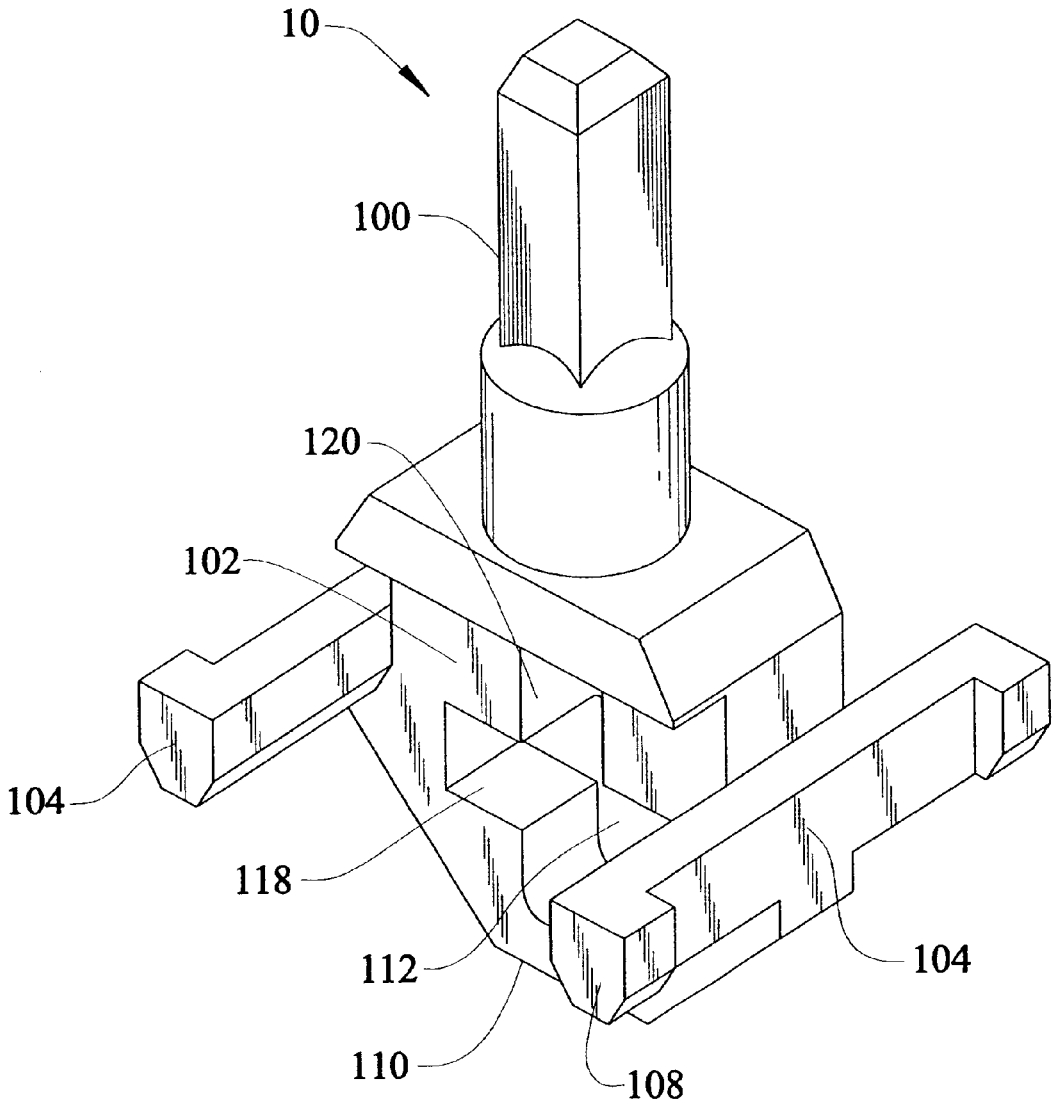
FIG. 4 is an enlarged perspective view of a push button utilized in the switch assembly of the invention.

FIG. 4 depicts a detailed view of push button 10 preferably used with the first embodiment of the invention. Extending upward from the push button 10 is an upper push button projection 100, which is preferably square in cross-section and includes a tapered tip. Below upper push button projection 100 is a push button body 102. Disposed laterally on each side of push button body 102 is a push button arm 104. At the two extreme ends of each push button arm 104 is an outwardly extending tab 108. On the opposite side of push button body 102 from upper push button projection 100 is a bottom projection 110 where the push button body 102 tapers and flattens off. In the center of the push button body 102 is a mounting aperture 112 in the shape of a cross-hair with a first mounting aperture 118 and a second mounting aperture 120.

Figure 5:
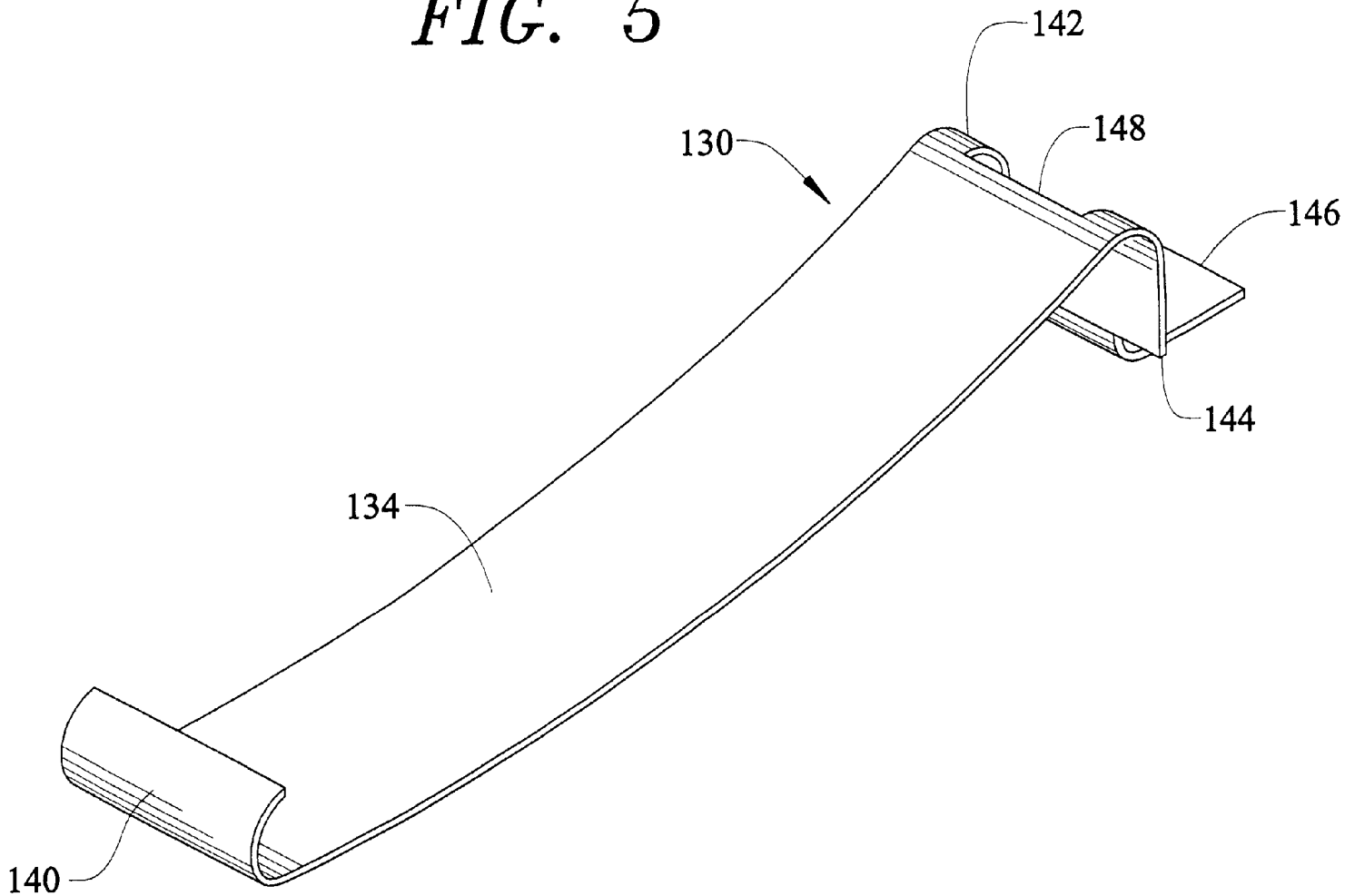
FIG. 5 is an upper perspective view of an electrical contact spring forming part of the switch assembly of FIG. 1.
Figure 6:
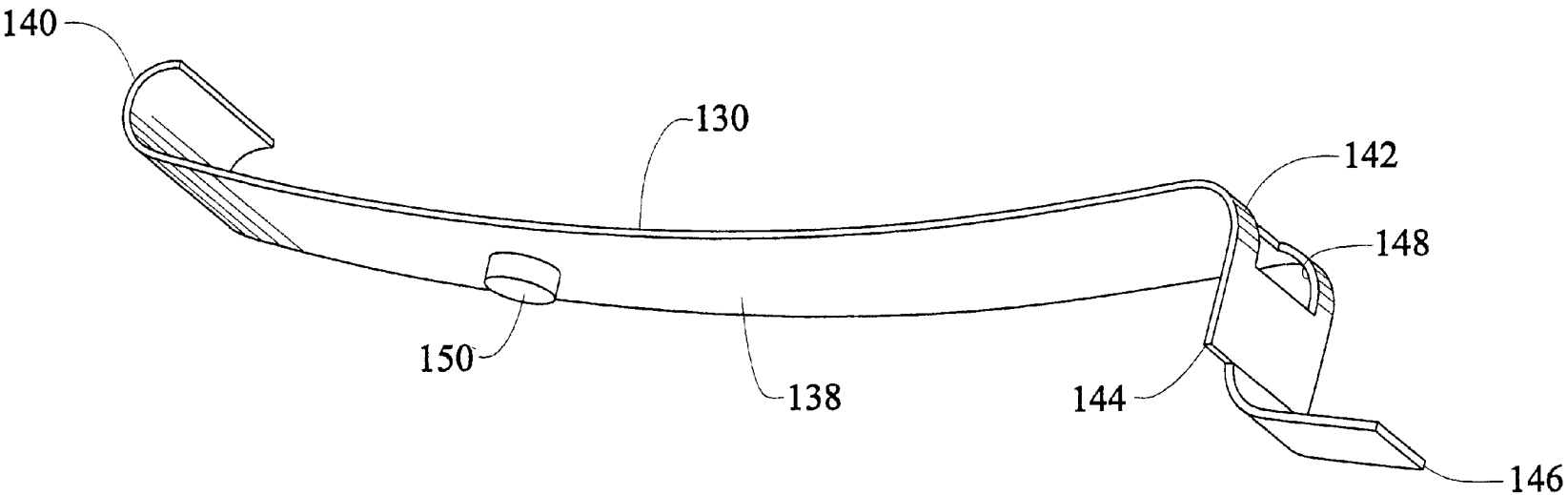
FIG. 6 is a lower perspective view of the contact spring of FIG. 5.

FIGS. 5 and 6 depict an elongated convex spring 130 used in the first embodiment of the invention. Basically, spring 130 is constituted by a curved piece of metal which has a first side 134 and a second side 138. Spring 130 has an upwardly and inwardly curved end 140. More specifically, upwardly curved end 140 preferably begins at one lateral end of the spring 130 and turns upwards 180°.

At the other end of spring 130 is a downwardly turned end 142. Where the convex section of spring 130 ends, a downward flange 144 extends. Extending at a substantially right angle to downward flange 144 is an extension 146. Along downwardly turned end 142 and a portion of flange 144 is formed a spring mounting aperture 148. In addition, a spring contact 150 is located at the apex of curvature of spring 130 on second side 138.

Figure 7:
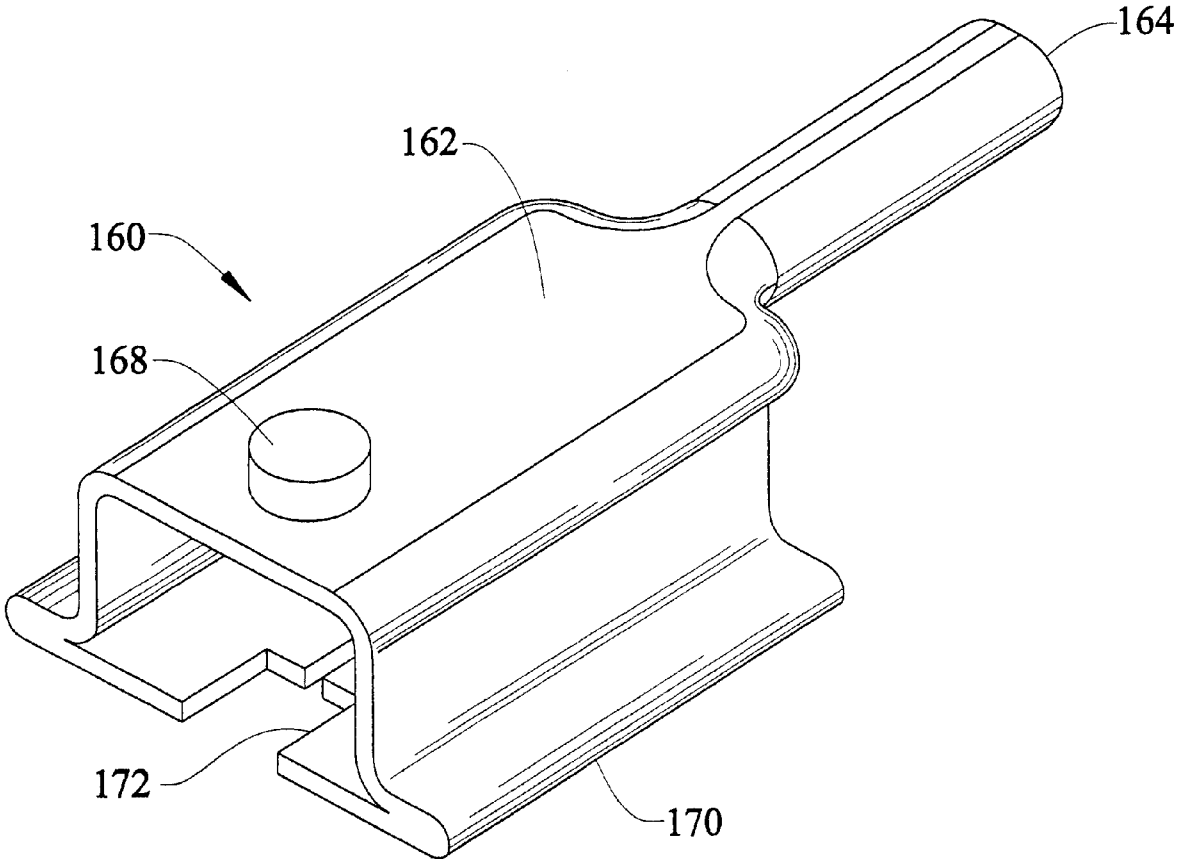
FIG. 7 is an upper perspective view of a stationary contact member utilized in the switch assembly of FIG. 1.

FIG. 7 depicts a contact member 160 used in accordance with the first embodiment of the invention. Contact member 160 is constructed of an electrically conductive material, preferably a metal, and includes an upper surface 162 which narrows to form a contact lead 164 at one end. Disposed on the upper surface 162, opposite contact lead 164, is a contact 168. Laterally spaced below upper surface 162 are opposed mounting feet 170. Directly below contact 168, between mounting feet 170, is a contact mounting aperture 172 that corresponds in size and shape to contact mounting projection tab 72.

Figure 8:
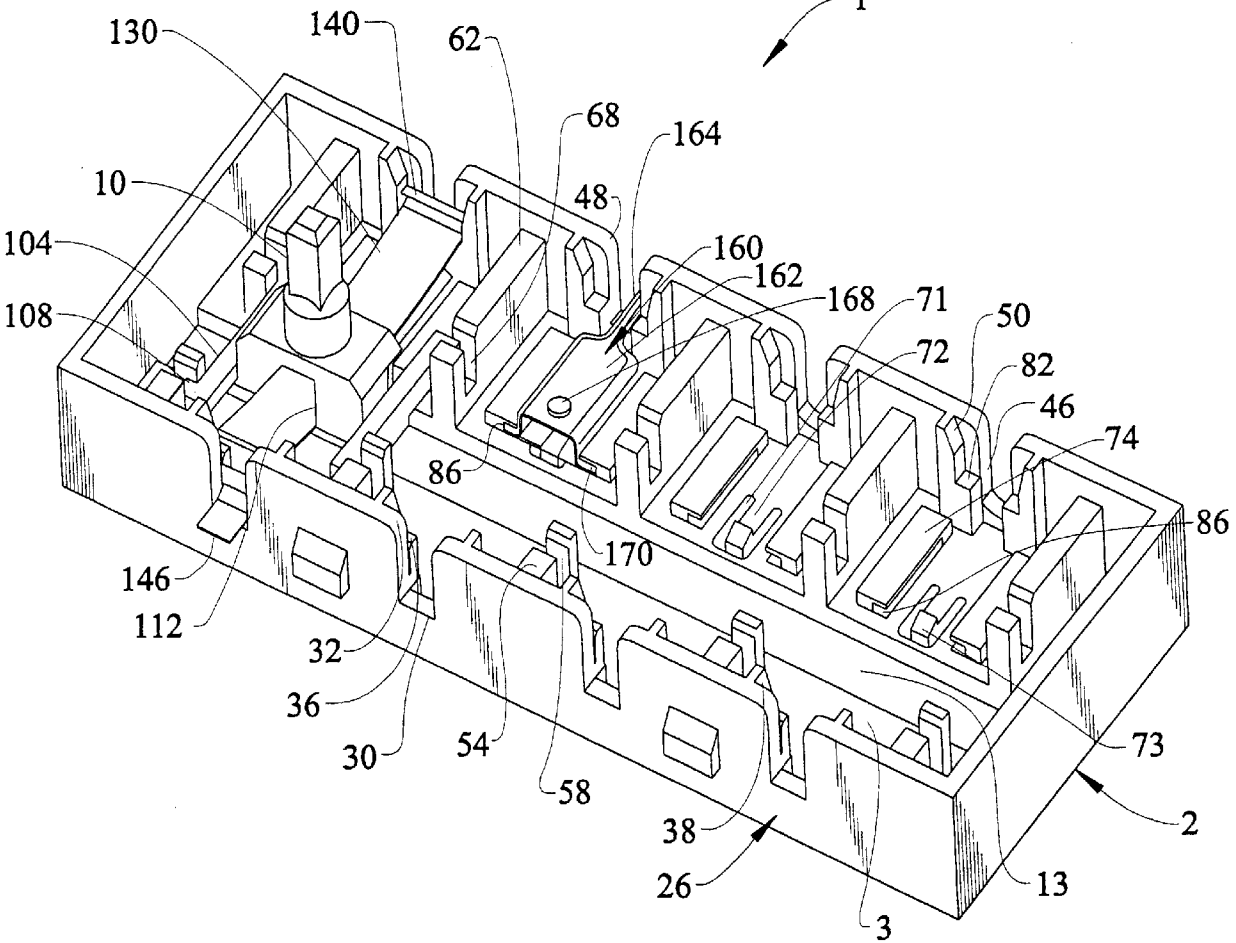
FIG. 8 is a perspective view of the lower housing of the switch assembly, similar to that of FIG. 3, but depicting the switch assembly in a partially assembled condition.

FIG. 8 depicts a completely assembled switch in a first or leftmost switch bay 26, a partially assembled switch in a second, adjacent switch bay 26, and two empty switch bays 26. The distinction between the structures in the first switch bay 26 and the second switch bay 26 is the presence of the push button 10 and the spring 130. In the first and second switch bays 26, the contact member 160 has been installed, but because the push button 10 and spring 130 obscure the contact member 160 from view, the push button 10 and spring 130 have been removed from the second switch bay 26 to aid in explanation.

In order to assemble the switch assembly 1 of the invention, it is necessary to install the parts in the correct order. First, the contact member 160 must be slid into place. More specifically, each mounting foot 170 extends into the respective set of grooves 86 associated with an adjacent pair of mounting feet 170 until the respective contact mounting tab 72 ramps into the contact mounting aperture 172 of the contact member 160. The internal biasing force of the contact mounting tab 72, in combination with mounting feet 170 being within grooves 86, maintains the contact member 160 in place. In addition, sliding the contact member 160 into place causes the contact lead 164 to assume the correct position in the rounded slot 46 of the housing 2.

Next, the spring 130 is inserted into the mounting aperture 112 of the push button 10. The extended tab 146 of the spring 130 is then inserted into the squared slot 30 and rests atop the lower plateau 34. The radiused surfaces 32 of the squared slot 30 aid in correctly positioning the extended tab 146 in the squared slot 30 because, if the extended tab 146 is slightly misaligned during installation, it slides along one of the radiused surfaces 32 until it correctly fits into the squared slot 30. The downwardly turned end 142 sits atop the upper plateau 36, while being guided into position due to the presence of ramped surfaces 38 and radiused surfaces 32.

The upwardly curved end 140 of the spring 130 is inserted largely in the same manner. More specifically, the upwardly curved end 140 is dropped down above a portion of the respective rounded slot 46, using the ramped surfaces 50 as guides until it reaches the contact plateau 82. The location of the contact plateau 82 in relation to the bottom of the rounded slot 46 ensures that the spring 130, via the upwardly turned end 140, does not come into electrical communication with the contact lead 164 of the contact member 160 by maintaining a distance between the two elements. The push button 10 is seated by positioning the push button arm tabs 108 into the short mounting projection slots 58 and the long mounting projection slots 68. Because of the design of the push button 10 and the housing 2, the projection slots 58 and 68 prevent the push button 10 from sliding along the spring 130 once both the spring 130 and the push button 10 are mounted within the housing 2. Finally, wires (not shown) may be connected to the extended tab 146 and to the contact lead 164, and the cover 4 is placed onto the housing 2. When the cover 4 is installed, the short spacers 22 not only assist in seating cover 4 correctly, but pinch the upwardly curved end 140 and downwardly turned end 142 of the spring 130 to maintain their desired positions.

In the preferred embodiment, the switch assembly 1 constitutes an on-off switch. FIG. 8 depicts the fully assembled switch assembly 1 in the on position, wherein an electrical connection is made between contacts 150 and 168. When the switch assembly 1 is in the on position, the push button 10 is in the down or depressed position, which forces spring 130 into the curved position shown in FIG. 8. Because of the interaction between spring 130, push button 10 and the projection of housing 2, the switch assembly 1 can be maintained in the on position until forced to the off position. In a further preferred embodiment, extending between the switch bays 26 can be cams and levers (not shown) within the housing 2. When one push button 10 is depressed, the cams and levers can force the other push buttons 10 into the off position. In any case, the interaction of the spring 130, push button 10 and projections of the housing 2 maintains the switch assembly in its off position.

The switch may alternatively be a momentary switch, wherein the spring 130 returns to a default position when depressed. In this embodiment, the contact 150 of spring 130 and contact 168 are maintained out of electrical communication by the internal forces of the spring 130. When the push button 10 is depressed, causing pressure at the apex of the spring 130, the upwardly curved end 140 and the downwardly turned end 142 are pushed downward toward bottom 13 of housing 2. But, the construction of housing 2 prevents such movement. The only movement permitted is the deformation of spring 130 to a slightly more convex configuration, thus bringing spring contact 150 and contact 168 into abutment and allowing electricity to flow between the wires connected to spring 130 and contact member 160. When the pressure is removed from push button 10, spring 130 returns to its default position, thus separating contacts 150 and 168.

Figure 9:
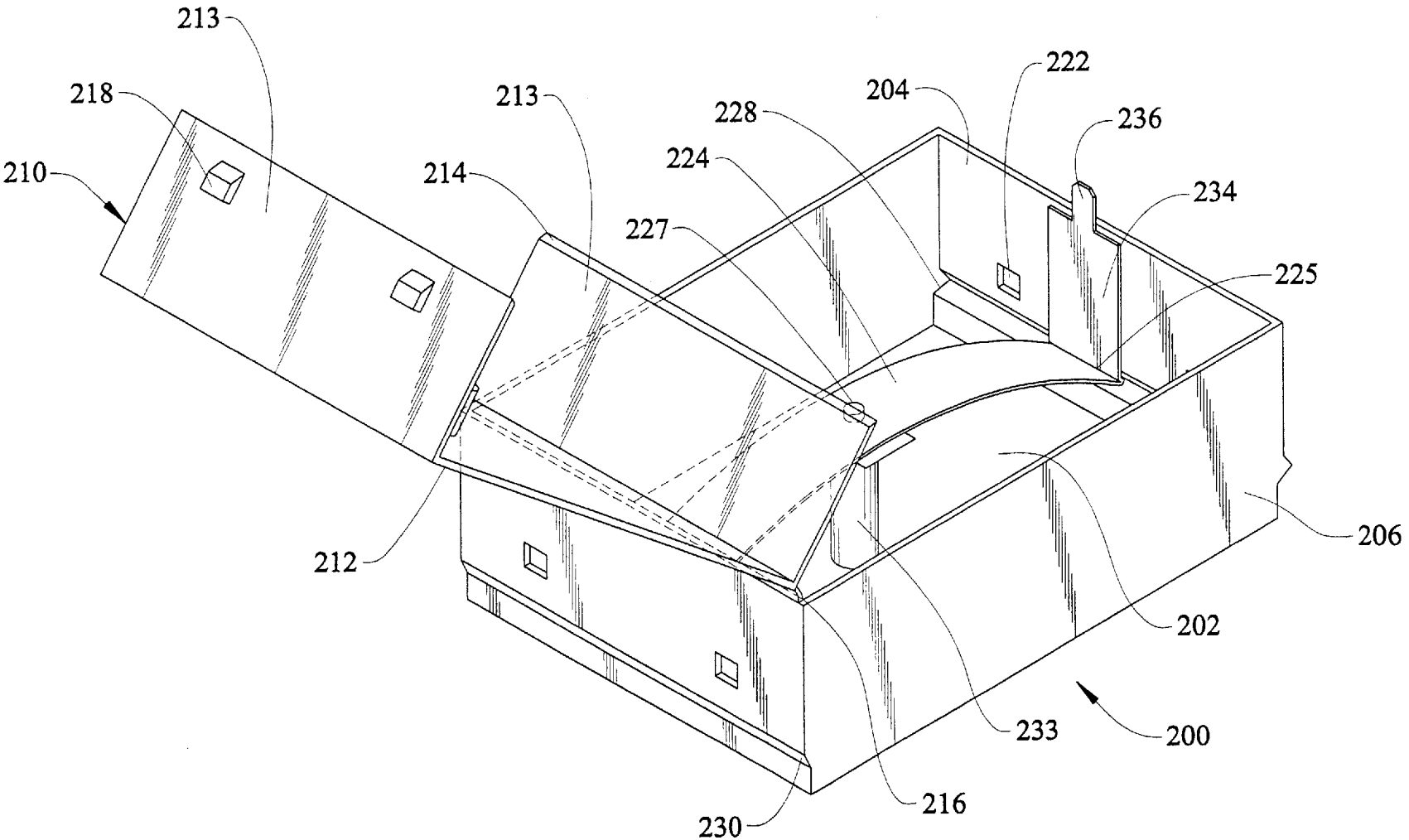
FIG. 9 is a perspective view of a switch assembly constructed in accordance with a second embodiment of the invention, with a hinged cover of the switch assembly shown in an open position.

FIGS. 9, 10 and 11 depict another preferred embodiment of the invention. In this embodiment, there is a hinged housing 200 which includes a generally rectangularly shaped housing face 202. Along two parallel sides of the housing face 202 are a pair of upstanding, spaced apart short box sides 204 and upstanding spaced apart two long box sides 206 extending along the remaining sides of the housing face 202. Each of short box sides 204 and long box sides 206 preferably stands at a right angle from housing face 202.

Opposite housing face 202, attached to one of short box sides 204 is a hinged cover 210. The hinged cover 210 includes a planar cover side 212, which has substantially similar dimensions as housing face 202, and a pair of upstanding spaced apart short cover sides 213. Short cover sides 213 are located at right angles to cover side 212. Each short cover side 213 has a sloped surface 214 opposite cover side 212, such that the outer surface of short cover side 213 is longer than the inner surface. At the junction between one short cover side 213 and elongated cover side 212 is a living hinge 216, constructed of a bendable material. Spaced near the bottom of each of short cover sides 213 are a pair of cover closing tabs 218. Cover closing tabs 218 are small protrusions which resemble cover mounting tabs 14 of the first embodiment. Located on each of short sides 204 are a pair of cover closing apertures 222 designed to receive cover closing tabs 218 on hinged cover 202.

Located inside and running down the long axis of hinged housing 200 is a spring 224. Spring 224, like spring 130 of the first embodiment, is constituted by a convexly curved, deflectable material, such as spring steel, with two ends. The first end defines a creased spring end 225 which is formed by bending spring 224 back upon itself. The other end is simply a flat spring end 226, as can be seen in FIGS. 10 and 11. At the apex of curvature of spring 224, there is a spring contact 227. On one of short box sides 204 is a short side box groove 228 into which creased spring end 225 is designed to fit. Short box side groove 228 is preferably constituted by an integrally molded V-shaped groove. At approximately the same height on opposite short side 204, there is a short box side ledge 230. On creased spring end 225, after the bent section, spring 224 forms an upstanding end 234 leading to a terminal end 236. The terminal end 236 is centrally located across the width of second spring 224, but is substantially narrower. A push button 238 is shown as extending from the apex of spring 224 through housing face 202. This feature is better viewed in FIGS. 10 and 11.

FIG. 10 shows this embodiment of the invention after the installation of spring 224, but before hinged cover 210 is in place. While flat spring end 226 rests near short box side ledge 230, creased spring end 225 completely fits in short box side groove 228. With hinged cover 202 open, flat spring end 226 is not in its default position. Extending through elongated cover side 212 is a cover contact 240, including a wire crimp attachment 244 on the outside of hinged cover 202.

When hinged cover 202 is swung about living hinge 216, as shown in FIG. 11, each of short cover sides 213 fits inside and adjacent to short box sides 204. In addition, each of cover closing tabs 218 mate with their corresponding cover closing apertures 222 on hinged housing 200. When fully closed, sloped surfaces 214 of short cover sides 213 come into contact with respective ends of spring 224. More specifically, while one sloped surface 214 holds creased spring end 225 into short box side groove 228, the other sloped surface 214 actually pushes flat spring end 226 against ledge 230. Spring end 226 is prevented from moving because it is pinched between sloped surface 214 and short box side notch 230. Upstanding end 234 is pinched between short cover side 213 and short box side 204. Wires (not shown) may then be crimped to each of terminal end 236 of spring 224 and wire crimp attachment 244 to complete the overall construction. Although hinged housing 200 is shown in FIGS. 9–11 to contain only one switch, it is contemplated that hinged housing 200 may optionally be elongated to contain a plurality of switches, each with similar structures.

In the default position shown in FIG. 11, spring contact 227 and cover contact 240 are maintained out of electrical communication by spring 224. When pressure is applied to push button 238, spring 224 slightly deforms to allow spring contact 227 and cover contact 240 to come into electrical communication. Therefore, pressure applied to the apex of spring 224 can only cause deformation with a limited degree of shifting at end 226 occurring. When pressure is removed from push button 238, second spring 224 is permitted to return to its default position. As such, spring contact 227 and cover contact 240 are no longer in electrical communication.

Figure 12:
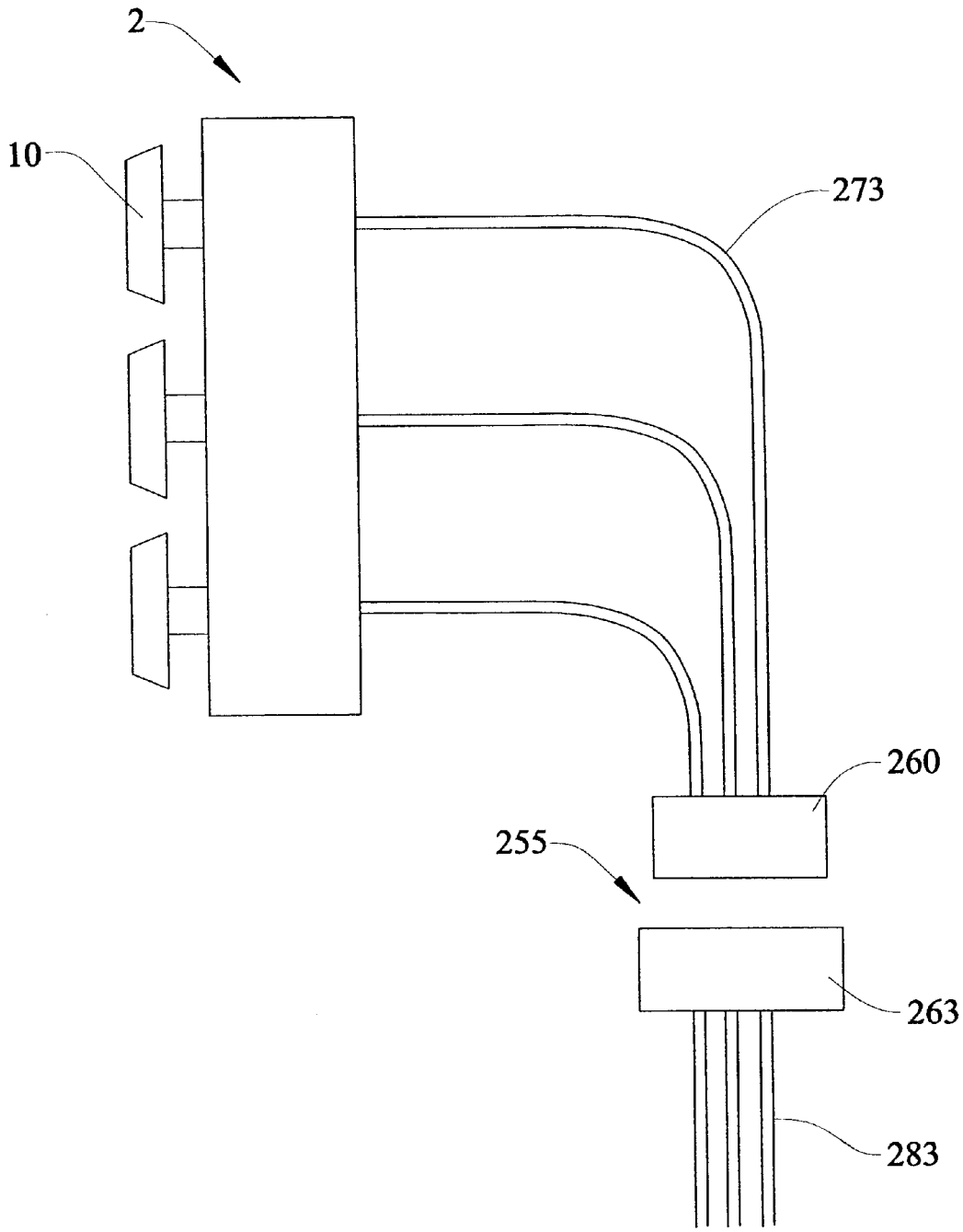
FIG. 12 depicts a wire harness arrangement utilized in connection with the switch assembly of the invention.

FIG. 12 depicts a wiring harness 255 which, although shown with reference to the first embodiment, optionally may be used with either embodiment of the invention. The wiring harness 255 includes first and second harness blocks 260 and 263. As shown, a plurality of wires 273 lead from housing 2 into harness block 260. In a similar manner, harness block 263 has extending therefrom a plurality of wires 283. By collecting each of the wires 273 and 283 into a single wiring harness 255, there are no longer loose wires and a simple, singular attachment can be made for ease of assembly. Although wiring harness 255 shown in FIG. 12 is used to simultaneously interconnect three individual wires 273 with wires 283, it is contemplated that wiring harness 255 may be used with a single set of wires 273, 283, or many wires depending on the particular design for the switch assembly.

Although described with reference to preferred embodiments of the invention, it should be understood that various changes and/or modifications can be made to the invention without departing from the spirit thereof. In general, the invention is only intended to be limited by the scope of the following claims.

We claim:

1. A switch assembly comprising:

a housing including a base, at least first and second upstanding sides, a longitudinal axis, and a transverse axis, said housing being formed with first and second, transversely spaced recesses;

a first contact mounted within said housing, said first contact including a first electrical lead;

a convex spring member defining a second contact, said convex spring member extending substantially, transversely within said housing and having a central portion, opposing sides, and first and second end portions, with said first end portion defining a second electrical lead, wherein the first and second end portions of said convex spring member are received in the first and second recesses respectively, and, upon deflection of said convex spring member, said central portion of said convex spring member engages the first contact such that the first and second leads are electrically interconnected through the convex spring member.

2. The switch assembly according to claim 1, wherein said convex spring member constitutes an over-center spring.

3. The switch assembly according to claim 1, further comprising: a push button supported by said housing, said push button being adapted to be manually depressed to deflect said convex spring member.

4. The switch assembly according to claim 1, wherein said second electrical lead extends completely through an aperture provided in said first upstanding side.

5. The switch assembly according to claim 1, wherein the second contact is formed separate from and attached to the central portion of the convex spring member, directly opposed to the first contact.

6. The switch assembly according to claim 5, further comprising: a push button supported by said housing, said push button being adapted to be manually depressed to deflect said convex spring member and directly engage the second contact with the first contact.

7. The switch assembly according to claim 1, wherein the base of said housing is formed with means for retaining the first contact in a fixed position.

8. The switch assembly according to claim 7, wherein said retaining means includes at least one groove for slidably receiving said first contact.

9. The switch assembly according to claim 1, further comprising: a wiring harness for simultaneously attaching a plurality of wires to said housing.

10. A switch assembly comprising:

a housing including a base, first and second opposing, upstanding sides extending from the base, and a cover snap-fittingly attached to said base;

an arcuate, electrically conductive spring including a central portion and first and second end portions, said spring extending between said upstanding sides within said housing;

a first electrical contact fixed to said housing;

a second electrical contact disposed on the central portion of said spring;

a push button projecting from within said housing, said push button being adapted to be shifted relative to said housing to deflect said spring and cause said second contact to engage the first contact; and means, carried by said cover, for abutting at least one of the first and second end portions of the spring to retain a desired positioning of the spring within said housing.

11. The switch assembly according to claim 10, wherein the cover is hinged to the base of said housing.

12. The switch assembly according to claim 11, further comprising: a living hinge interconnecting the cover to said base.

13. The switch assembly according to claim 10, wherein said cover includes a pair of wall members adapted to directly abut said spring.

14. The switch assembly according to claim 13, wherein said spring includes a creased section.

15. The switch assembly according to claim 14, wherein said housing is formed with opposing recesses into which the first end portion of the spring and the creased section extend.

16. The switch assembly according to claim 10, wherein the second end portion of said spring projects out of said housing to define an electrical lead.

17. The switch assembly according to claim 16, wherein the first end portion of said spring is curved.

18. The switch assembly according to claim 16, further comprising: a first wire attached to said electrical lead, and a second wire attached to said first contact.

19. The switch assembly according to claim 10, wherein said first contact is fixedly secured to said cover.

20. The switch assembly according to claim 10, further comprising: a wiring harness for simultaneously attaching a plurality of wires leading from said housing.

* * * * *